US011101530B2

(12) United States Patent
Yukawa et al.

(10) Patent No.: US 11,101,530 B2
(45) Date of Patent: Aug. 24, 2021

(54) POLARIZATION SEPARATION CIRCUIT

(71) Applicant: Mitsubishi Electric Corporation, Tokyo (JP)

(72) Inventors: Hidenori Yukawa, Tokyo (JP); Yu Ushijima, Tokyo (JP); Motomi Watanabe, Tokyo (JP); Jun Goto, Tokyo (JP); Naofumi Yoneda, Tokyo (JP); Shinji Arai, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 154 days.

(21) Appl. No.: 16/607,220

(22) PCT Filed: May 26, 2017

(86) PCT No.: PCT/JP2017/019747
§ 371 (c)(1),
(2) Date: Oct. 22, 2019

(87) PCT Pub. No.: WO2018/216210
PCT Pub. Date: Nov. 29, 2018

(65) Prior Publication Data
US 2020/0381794 A1 Dec. 3, 2020

(51) Int. Cl.
*H01Q 15/24* (2006.01)
*H01P 1/16* (2006.01)
(Continued)

(52) U.S. Cl.
CPC ..... *H01P 1/171* (2013.01); *H01P 3/123* (2013.01)

(58) Field of Classification Search
CPC ..... H01Q 1/12; H01Q 1/1214; H01Q 13/20; H01Q 13/28; H01Q 15/24; H01Q 19/02;
(Continued)

(56) References Cited

U.S. PATENT DOCUMENTS 3,958,192 A * 5/1976 Rootsey ..... H01P 5/12 333/125
9,147,921 B2 * 9/2015 Delgado ..... H01P 1/165
(Continued)

OTHER PUBLICATIONS

Lecian et al., "X Band Septum Polarizer as Feed for Parabolic Antenna", 2010 15th Conference on Microwave Techniques, 2010, pp. 1-4.

*Primary Examiner* — Tho G Phan
(74) *Attorney, Agent, or Firm* — Birch, Stewart, Kolasch & Birch LLP

(57) ABSTRACT

A square waveguide (1) has four ridges (6*a*, 6*b*, 7*a*, 7*b*). The cross section of the square waveguide (1) perpendicular to a waveguide axial direction is square. Inside the square waveguide (1), two rectangular waveguide terminals (4, 5) are formed by partitioning the inside along the waveguide axial direction. A septum phase plate (2) formed to get narrower stepwisely as its gets closer to a square waveguide terminal (3) opposite to the rectangular waveguide terminals (4, 5) is provided. A projecting portion (8) is provided on a part of a ridge (7*b*) formed on a ridge-side wall surface opposite to a wall surface, the septum phase plate (2) being joined to the wall surface in a part where the septum phase plate has largest width, the projecting portion (8) being larger than other parts of the ridge (7*b*) in a cross-sectional shape perpendicular to the waveguide axial direction.

5 Claims, 9 Drawing Sheets

(51) Int. Cl.
*H01P 1/17* (2006.01)
*H01P 3/123* (2006.01)

(58) Field of Classification Search
CPC ..... H01Q 19/13; H01Q 19/17; H01P 1/17; H01P 1/171; H01P 3/08; H01P 3/12; H01P 3/123; H01P 1/161; H01P 1/16
See application file for complete search history.

(56) References Cited

U.S. PATENT DOCUMENTS

| | | | | |
|---|---|---|---|---|
| 9,246,226 | B2 * | 1/2016 | Voss | H01Q 13/0283 |
| 9,929,454 | B2 * | 3/2018 | Ushijima | H01P 1/17 |
| 10,020,554 | B2 * | 7/2018 | Parekh | H01Q 19/132 |
| 10,096,876 | B2 * | 10/2018 | Jensen | H01P 3/123 |
| 2015/0011159 | A1 | 1/2015 | Marinov et al. | |

* cited by examiner

POLARIZATION SEPARATION CIRCUIT

TECHNICAL FIELD

The present invention relates to a polarization separation circuit that is mainly used in VHF band, UHF band, microwave band, and millimeter wave band.

BACKGROUND ART

As a circuit that separates two orthogonal circularly polarized signals (right-handed and left-handed) or two orthogonal linearly polarized signals (vertical and horizontal), a septum polarizer having a structured in which a septum phase plate is inserted in a square waveguide is known.

A conventional septum polarizer includes a square waveguide and a septum phase plate, and has a square waveguide terminal and two rectangular terminals. The septum phase plate is inserted in such a manner that two rectangular waveguide terminals are formed in the square waveguide, and is formed to be narrower in a stepwise manner as it gets closer to the square waveguide terminal.

In such a circuit, when two orthogonal circularly polarized signals (right-handed and left-handed) are inputted from the square waveguide terminal, the circularly polarized signals are converted into linearly polarized signals, respectively, and they are outputted from the different rectangular waveguide terminals. In addition, when two orthogonal linearly polarized signals are inputted from the square waveguide terminal, for a linearly polarized signal vertical to the septum phase plate, linearly polarized signals are outputted in the same direction of electric fields from the rectangular waveguide, and for a linearly polarized signal in parallel with the septum phase plate, linearly polarized signals are outputted in directions of electric fields facing each other from the rectangular waveguide.

In either case of inputting circularly polarized signals or linearly polarized signals, polarization separation characteristics are determined in accordance with the size and the plate thickness of step portions of the septum phase plate.

In addition, as a technique for reducing the aperture size of a waveguide, providing ridges is known. A ridge is generally formed of a projecting portion having a rectangular cross-sectional shape. By providing ridges, the cut-off frequency of the waveguide can be decreased, and thus, when the same cut-off frequency as that of a waveguide with no ridges provided therein is intended, there is an advantage in that the cross-section size can be reduced by providing ridges. Hence, there is a structure in which ridges are provided on a septum polarizer (see, for example, Patent Literature 1).

CITATION LIST

Patent Literatures

Patent Literature 1: US 2015/0,011,159 A

SUMMARY OF INVENTION

Technical Problem

However, although the conventional septum polarizer having ridges can achieve size reduction, there is a problem of deterioration in characteristics such as axial ratio, due to influence of the ridges.

The present invention is made to solve the problem, and an object of the invention is to provide a polarization separation circuit capable of improving the axial ratio of the polarization separation circuit.

Solution to Problem

A polarization separation circuit according to the invention includes: a square waveguide whose cross section perpendicular to a waveguide axial direction is square, the square waveguide having four ridges; a septum phase plate forming two rectangular waveguide terminals by partitioning inside of the square waveguide along the waveguide axial direction, the septum phase plate being formed to get narrower in a stepwise manner as the septum phase plate gets closer to a square waveguide terminal opposite to the two rectangular waveguide terminals of the square waveguide; and a projecting portion provided on a part of a ridge among the four ridges on an opposite side wall surface to a wall surface, the septum phase plate being joined to the wall surface in a part in which the septum phase plate has largest width, the projecting portion being larger than other parts of the ridge in a cross-sectional shape perpendicular to the waveguide axial direction.

Advantageous Effects of Invention

The polarization separation circuit according to the invention includes a projecting portion provided on a part of a ridge among the four ridges on an opposite side wall surface to a wall surface, the septum phase plate being joined to the wall surface in a part in which the septum phase plate has largest width, the projecting portion being larger than other parts of the ridge in a cross-sectional shape perpendicular to the waveguide axial direction. By this configuration, excellent axial ratio characteristics can be obtained.

DESCRIPTION OF EMBODIMENTS

To describe the invention in more detail, some embodiments for carrying out the invention will be described below with reference to the accompanying drawings.

First Embodiment

Figure 1:
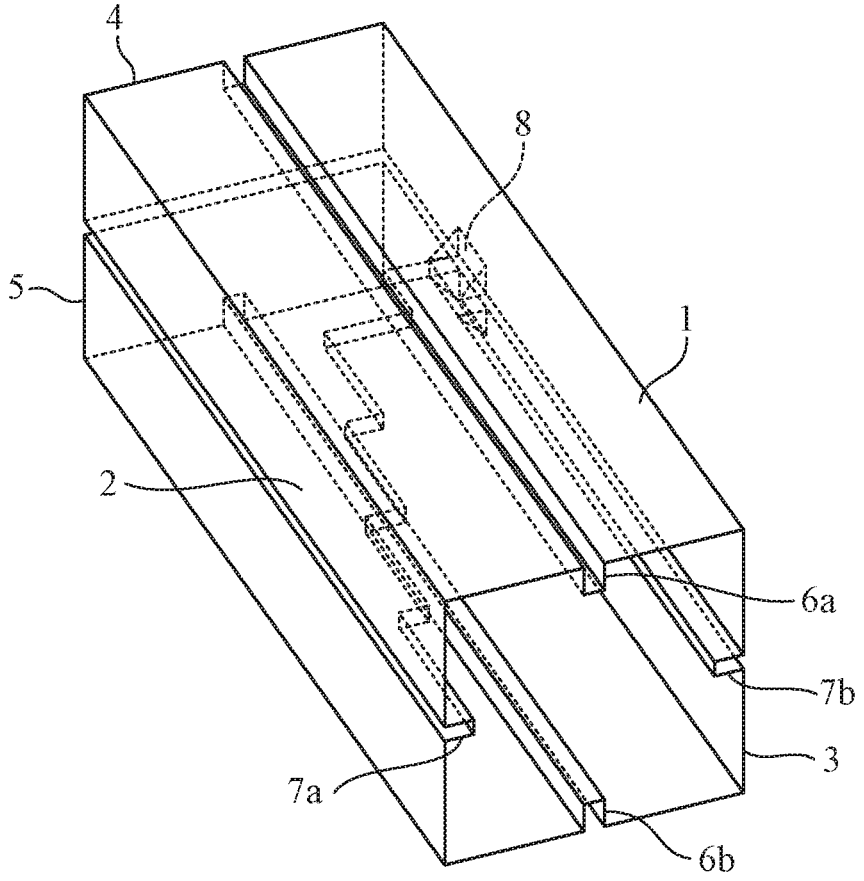
FIG. 1 is a perspective view showing a polarization separation circuit of a first embodiment of the invention.

FIG. 1 is a perspective view showing a configuration of a polarization separation circuit of the present embodiment.

Figure 2:
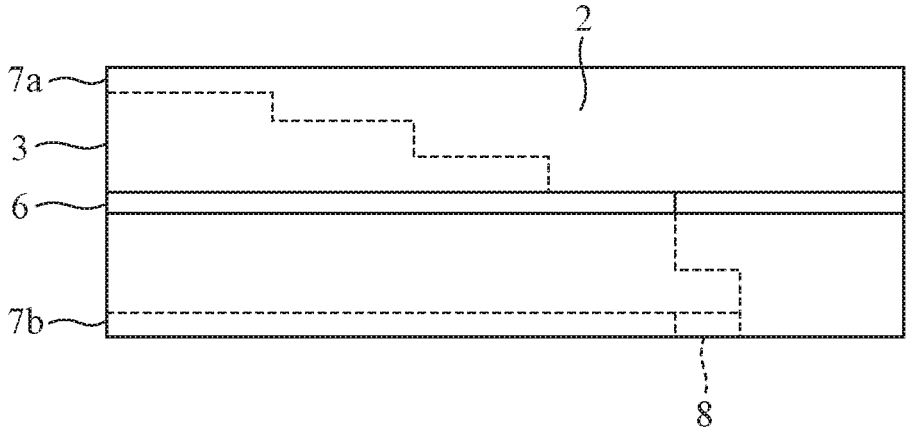
FIG. 2 is a plan view of the polarization separation circuit of the first embodiment of the invention.
Figure 3:
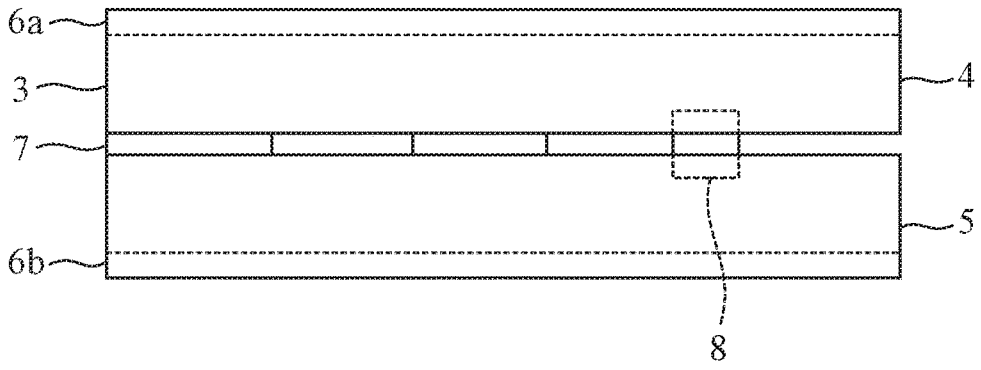
FIG. 3 is a side view of the polarization separation circuit of the first embodiment of the invention.
Figure 4:
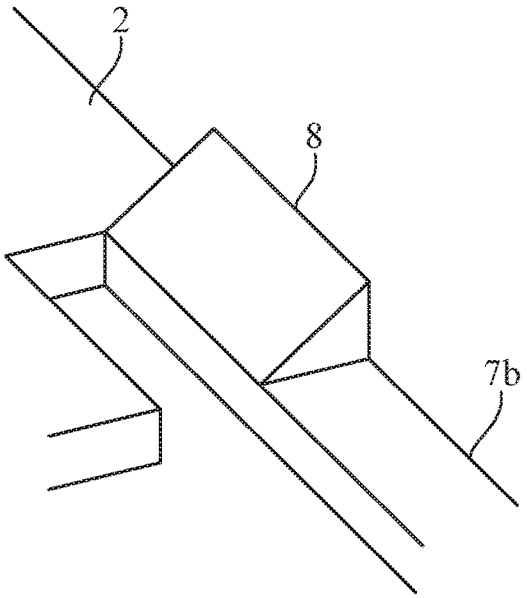
FIG. 4 is an enlarged perspective view of a portion around a projecting portion of the polarization separation circuit of the first embodiment of the invention.
Figure 5:
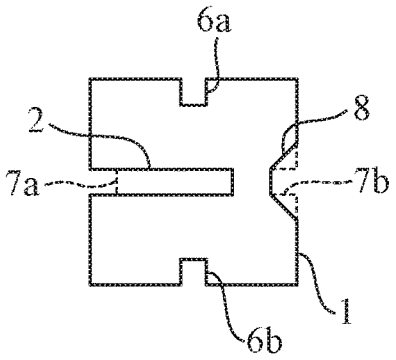
FIG. 5 is a cross-sectional view in a position in which the projecting portion is disposed in the polarization separation circuit of the first embodiment of the invention.

The polarization separation circuit shown in the diagram includes a square waveguide 1, a septum phase plate 2, a square waveguide terminal 3, and rectangular waveguide terminals 4 and 5, and further includes ridges 6*a* and 6*b* provided to walls positioned in the orthogonal direction to the septum phase plate 2, ridges 7*a* and 7*b* parallel to the septum phase plate 2, and a projecting portion 8 provided on the ridge 7*b*. In addition, FIG. 2 shows a plan view, FIG. 3 shows a side view, FIG. 4 shows an enlarged view of a portion around the projecting portion 8, and FIG. 5 shows a cross-sectional view in a position in which the projecting portion 8 is disposed.

In these diagrams, the square waveguide 1 is a waveguide whose cross section perpendicular to a waveguide axial direction is formed in a square, and which includes the four ridges 6*a*, 6*b*, 7*a*, and 7*b* parallel to the waveguide axial direction. The septum phase plate 2 forms the two rectangular waveguide terminals 4 and 5 by partitioning the inside of the square waveguide 1 along the waveguide axial direction, and is formed to get narrower in its width in a stepwise manner as it gets closer to the square waveguide terminal 3 opposite to the two rectangular waveguide terminals 4 and 5 of the square waveguide 1. The ridges 6*a* and 6*b* are provided to the walls positioned in the orthogonal direction to the septum phase plate 2, and the ridges 7*a* and 7*b* are parallel to the septum phase plate 2. The ridges 6*a* and 6*b*, the ridges 7*a* and 7*b*, and the projecting portion 8 are recessed portions when viewed from the outside of the square waveguide 1, but are raised portions when viewed from the inside of the square waveguide 1, and projected toward the inside of the square waveguide 1. The projecting portion 8 is provided on the ridge 7*b* and whose cross-sectional shape perpendicular to the waveguide axial direction is different to that of the ridge 7*b*, and is provided inside the square waveguide 1 on a ridge-side wall surface opposite to a wall surface, the septum phase plate being joined to the wall surface in a part in which the septum phase plate has the largest width. Each of the ridges 6*a* and 6*b* and the ridges 7*a* and 7*b* has a rectangular cross-sectional shape, and the projecting portion 8 has a trapezoidal cross-sectional shape whose top base has the width of the ridge 7*b*.

Next, an operation of the polarization separation circuit of the first embodiment will be described. In the following, a case in which no ridge is provided, a case in which ridges are provided, and a case in which a projecting portion is provided are described in turn.

Figure 6A:
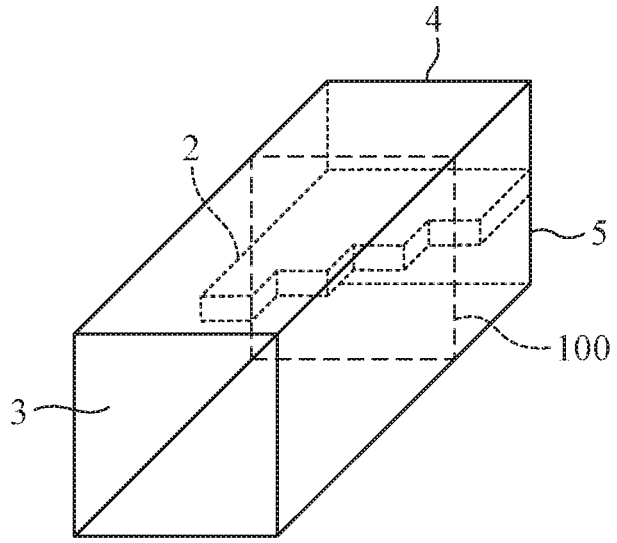
FIG. 6A is a perspective view for a case in which ridges are not provided in the polarization separation circuit of the first embodiment of the invention.
Figure 6B:
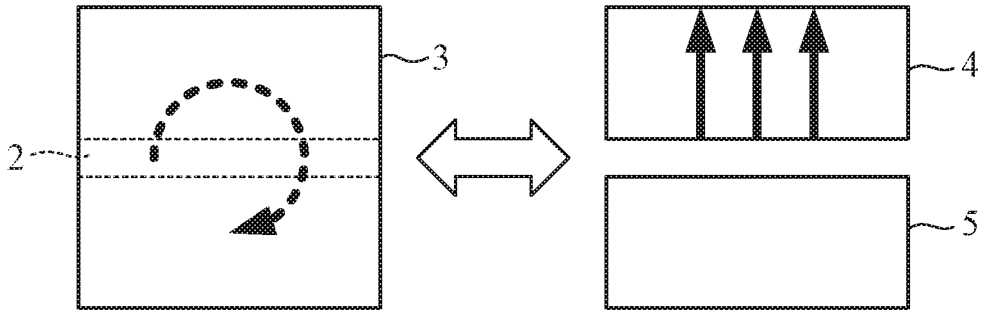
FIGS. 6B and 6C are illustrative diagrams for a case in which two orthogonal circularly polarized signals are inputted from a square waveguide terminal.
Figure 6C:
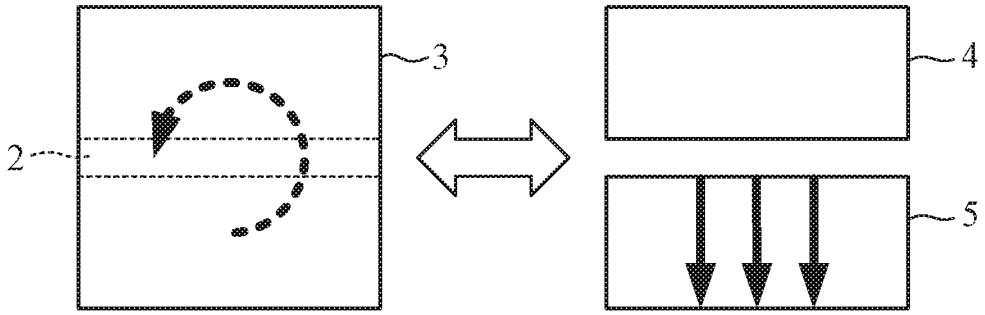
Figure 7A:
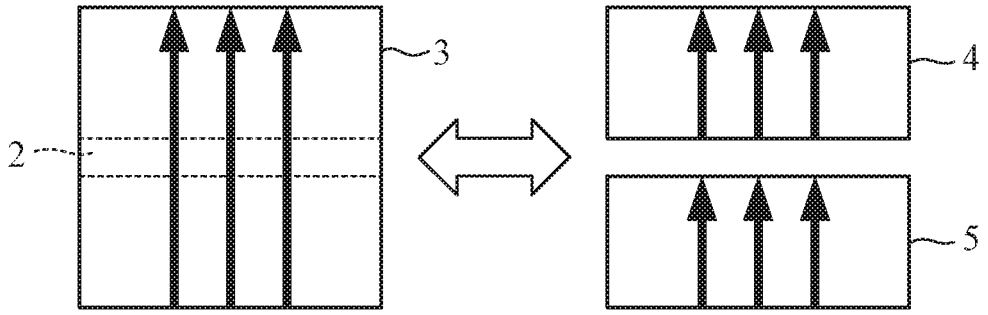
FIGS. 7A and 7B are illustrative diagrams for a case in which linearly polarized signals are inputted from the square waveguide terminal of the polarization separation circuit of the first embodiment of the invention.
Figure 7B:
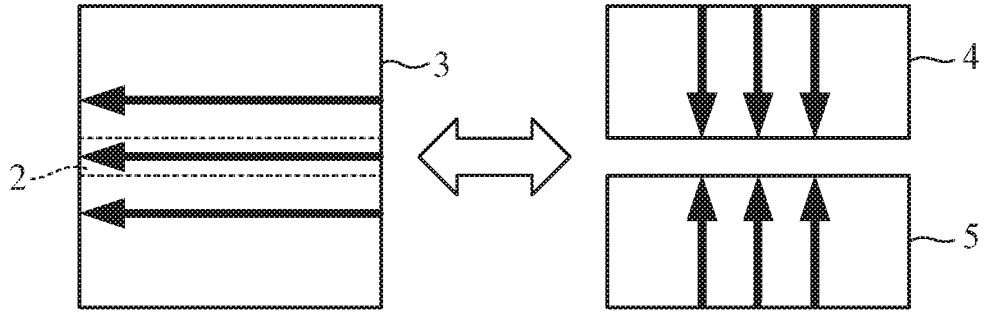

FIG. 6A shows a waveguide in which no ridges is provided. In the waveguide, when two orthogonal circularly polarized signals (right-handed and left-handed) are inputted from the square waveguide terminal 3, as shown in FIGS. 6B and 6C, they are converted into linearly polarized signals, respectively, and the linearly polarized signals are outputted from the different rectangular waveguide terminals 4 and 5. In addition, when two orthogonal linearly polarized signals are inputted from the square waveguide terminal 3, for a linearly polarized signal vertical to the septum phase plate 2, linearly polarized signals are outputted in the same direction of electric fields (see FIG. 7A) from the rectangular waveguide terminals 4 and 5, and for a linearly polarized signal horizontal to the septum phase plate 2, linearly polarized signals are outputted in directions of electric fields facing each other (see FIG. 7B) from the rectangular waveguide terminals 4 and 5. Note that in FIGS. 6 and 7, the arrows on cross sections on which the square waveguide terminal 3, the rectangular waveguide terminals 4 and 5, and the septum phase plate 2 are provided indicate directions of electric fields.

Figure 8A:
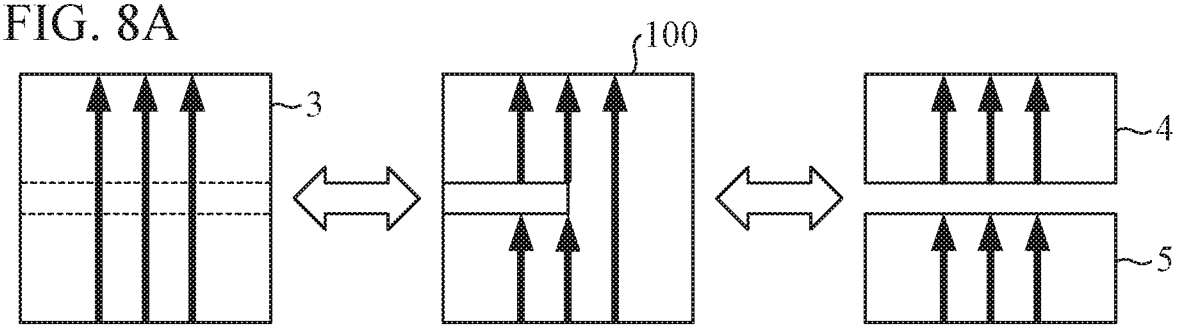
FIGS. 8A and 8B are illustrative diagrams showing changes in electric field distribution for a case in which linearly polarized signals are inputted from the square waveguide terminal of the polarization separation circuit of the first embodiment of the invention.
Figure 8B:
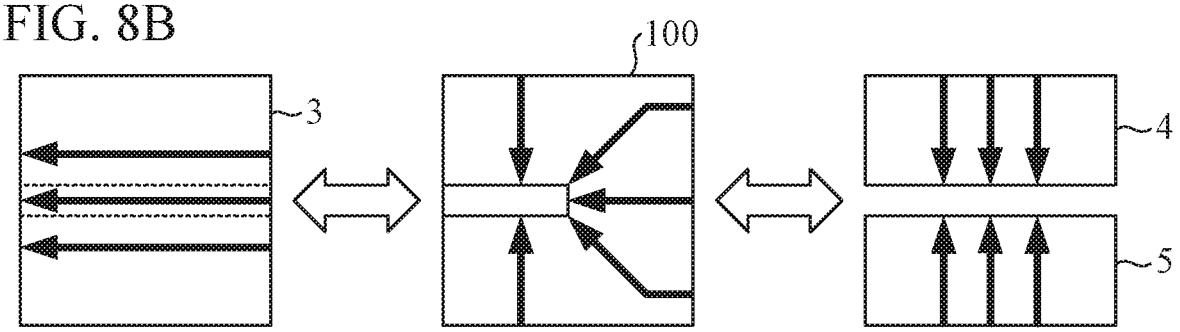

For a principle of polarization separation shown as above, for simplification of description, changes in electric field distribution in a case in which two orthogonal linearly polarized signals are inputted from the square waveguide terminal 3 will be described. When two orthogonal linearly polarized signals are inputted from the square waveguide terminal 3, on a waveguide cross section 100 on which the septum phase plate 2 is provided, for each polarization, transient electric field distribution occurs as shown in FIGS. 8A and 8B. Note that, also in FIGS. 8A and 8B, the arrows on the square waveguide terminal 3, the rectangular waveguide terminals 4 and 5, and the waveguide cross section 100 indicate the directions of electric fields. Further, the waveguide cross section 100 is a cross section in a position corresponding to the portion in which the projecting portion 8 is disposed.

Figure 9A:
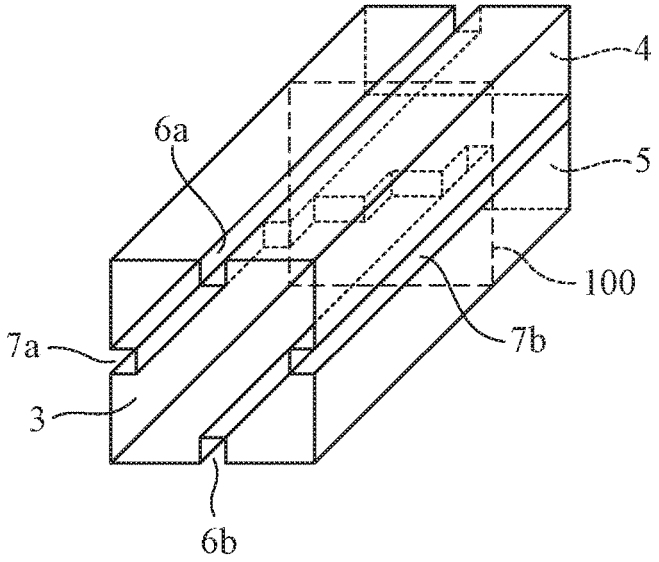
FIG. 9A is a perspective view for a case in which ridges are provided to the polarization separation circuit of the first embodiment of the invention.
Figure 9B:
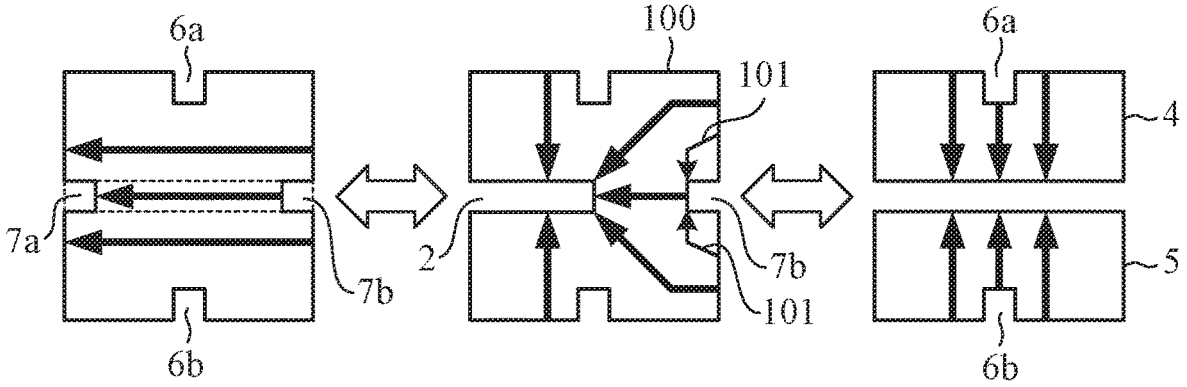
FIG. 9B is an illustrative diagram showing changes in electric field distribution for a case in which linearly polarized signals are inputted from the square waveguide terminal.

Next, a case in which ridges are provided to reduce the aperture size of the waveguide is shown. FIG. 9A shows a waveguide in which the ridges 6*a*, 6*b*, 7*a*, and 7*b* are provided. In the structure in which the ridges 6*a*, 6*b*, 7*a*, and 7*b* are provided on the waveguide, transient electric field distribution as shown in FIG. 9B is generated. In this case, since the ridges 6*a*, 6*b*, 7*a*, and 7*b* are provided, as shown in FIG. 9B, unwanted electric field components traveling from a wall surface toward an edge of the ridge 7*b* (arrows 101 in the diagram) occur near the ridge 7*b* facing the septum phase plate 2. Hence, a smooth conversion of an electric field distribution is hindered compared to the case of FIGS. 8A and 8B. As a result, the characteristics deteriorate.

Figure 10:
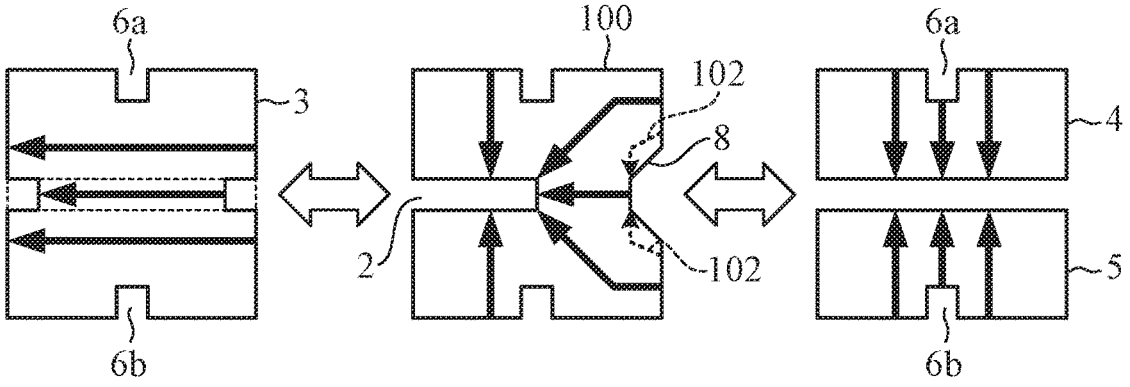
FIG. 10 is an illustrative diagram showing changes in electric field distribution for a case in which the projecting portion is provided to the polarization separation circuit of the first embodiment of the invention.

Next, a case in which the projecting portion 8 is provided will be described. In a structure in which the projecting portion 8 is provided, transient electric field distribution as shown in FIG. 10 is generated. In this case, by the projecting portion 8, unwanted electric field components traveling from the wall surface toward the edge of the ridge (indicated by dashed-line arrows 102 in the diagram) become less likely to occur. Hence, a smooth conversion of electric field distribution is achieved.

In the above, a case in which horizontally polarized wave is inputted in a structure in which the ridges 6*a*, 6*b*, 7*a*, and 7*b* are provided is described. On the other hand, in a case in which vertically polarized wave is inputted, electric field components near wall surfaces are small, and thus, influence of the ridges 6*a*, 6*b*, 7*a*, and 7*b* is small.

As described above, by providing the projecting portion 8, there is almost no influence when vertical polarization is inputted, and smooth conversion of electric field distribution is achieved when horizontal polarization is inputted, and thus, excellent axial ratio characteristics are obtained.

Figure 11:
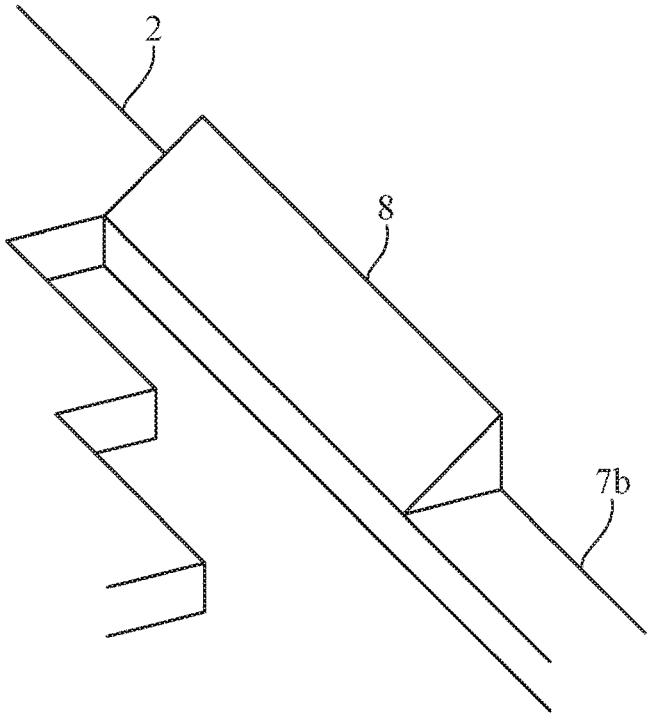
FIG. 11 is a perspective view showing another example of a projecting portion of the polarization separation circuit of the first embodiment of the invention.

Note that even if the entire ridge 7*b* is formed in the same trapezoidal cross-sectional shape as that of the projecting portion 8, the same advantageous effects are obtained, but since an advantageous effect obtained as the ridge is reduced, it becomes difficult to achieve size reduction. Hence, it is desirable that the projecting portion 8 is provided on a part of a ridge-side wall surface opposite to a wall surface to which the septum phase plate 2 is joined. Further, as shown in FIG. 11, the projecting portion 8 may be designed so that axial ratio and miniaturization can have a trade-off relationship by changing the length of the projecting portion 8.

As described above, the polarization separation circuit of the first embodiment includes: a square waveguide whose cross section perpendicular to a waveguide axial direction is square, the square waveguide having four ridges; a septum phase plate forming two rectangular waveguide terminals by partitioning inside of the square waveguide along the waveguide axial direction, the septum phase plate being formed to get narrower in a stepwise manner as the septum phase plate gets closer to a square waveguide terminal opposite to the two rectangular waveguide terminals of the square waveguide; and a projecting portion provided on a part of a ridge among the four ridges formed on a ridge-side wall surface opposite to a wall surface, the septum phase plate being joined to the wall surface in a part in which the septum phase plate has largest width, the projecting portion being larger than other parts of the ridge in a cross-sectional shape perpendicular to the waveguide axial direction. Thus, size reduction can be achieved and excellent axial ratio characteristics can be obtained.

In addition, according to the polarization separation circuit of the first embodiment, the cross-sectional shape of the projecting portion is a trapezoidal shape whose bottom base on a side of the ridge-side wall surface is larger than a top base of the trapezoidal shape opposite to the bottom base. Thus, the projecting portion can be easily processed.

Second Embodiment

A second embodiment is an example in which for a cross-sectional shape of a projecting portion, oblique sides that connect a bottom base on a wall-surface side to a top base opposite to the bottom base are formed in a curved shape.

Figure 12:
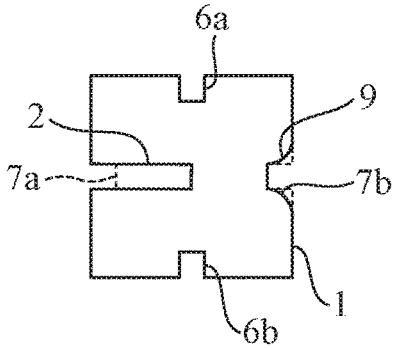
FIG. 12 is a cross-sectional view showing a polarization separation circuit of a second embodiment of the invention.

A basic configuration of a polarization separation circuit of the second embodiment is the same as that of the first embodiment shown in FIGS. 1 to 5, but the configuration of the projecting portion is different. FIG. 12 is a cross-sectional view of the square waveguide 1 in the position of a projecting portion 9 of the polarization separation circuit of the second embodiment. The projecting portion 9 of the second embodiment is formed in such a manner that the oblique-side portions of a trapezoid are formed in a curved shape. Namely, the oblique-side portions of the trapezoid is formed to be a rounded surface. Other portions are the same as those of the first embodiment and thus description of the other portions is omitted.

By forming the projecting portion 9 as described above, there is an advantageous effect that the manufacturing process by endmill is facilitated.

Figure 13:
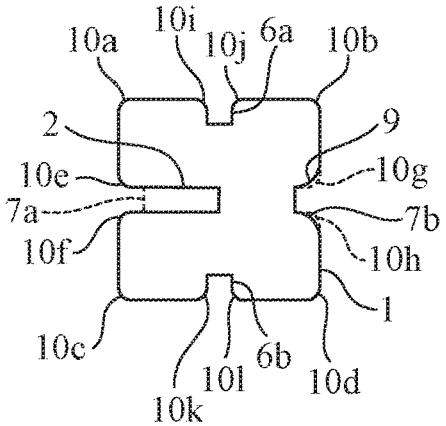
FIG. 13 is a cross-sectional view showing another example of a polarization separation circuit of the second embodiment of the invention.

In addition, as shown in FIG. 13, the cross-sectional shapes of corner portions of the square waveguide 1 and corner portions of the ridges 6*a* and 6*b* and the ridges 7*a* and 7*b* may be formed in a curved shape. Namely, the each corner portion may be formed to be a rounded surface. In FIG. 13, curved-surface portions 10*a* and 10*b* are provided on a rectangular waveguide terminal 4 side, curved-surface portions 10*c* and 10*d* are provided on a rectangular waveguide terminal 5 side, curved-surface portions 10*e* and 10*f* are provided on the ridge 7*a*, curved-surface portions 10*g* and 10*h* are provided on the ridge 7*b*, curved-surface portions 10*i* and 10*j* are provided on the ridge 6*a*, and curved-surface portions 10*k* and 10*l* are provided on the ridge 6*b*. Note that the curved-surface portions 10*a* to 10*l* are formed to have a smaller radius of curvature R than a radius of curvature R of the projecting portion 9.

By this configuration, all processing can be performed by an endmill and there is also an advantageous effect that processing is further facilitated.

Figure 14:
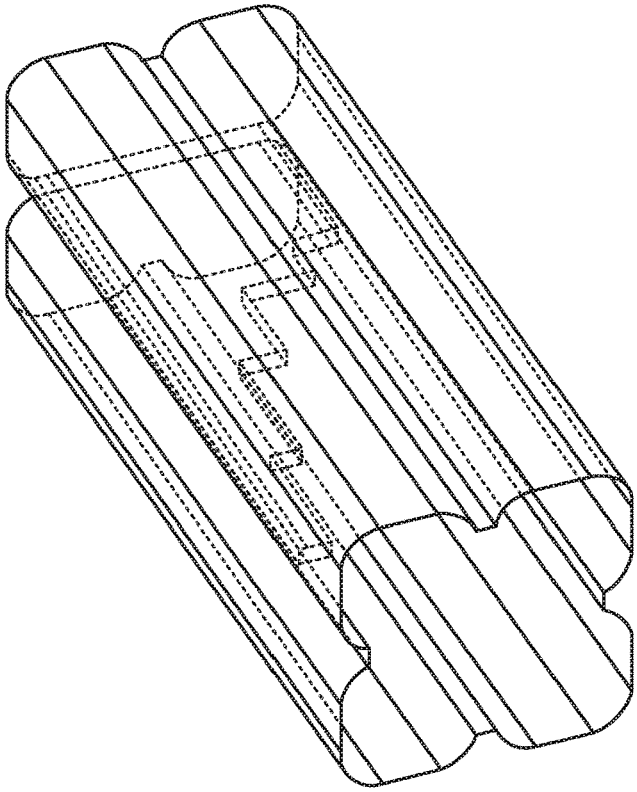
FIG. 14 is a perspective view for a case in which a projecting portion is not provided to the polarization separation circuit of the second embodiment of the invention.

We performed electromagnetic field computation for a polarization separation circuit having a configuration described above. Here, as the electromagnetic field computation, a comparison is made between a case in which a projecting portion is provided and a case in which no projecting portion is provided, using an electromagnetic field simulator ANSOFT_HFSS which is provided as a commercial product. Note that the cross-sectional shape of the projecting portion is formed to be a rounded surface having a radius of curvature R and other parts are formed to be rounded surfaces each having a smaller radius of curvature R than the projecting portion. FIG. 14 shows a structure in which the projecting portion 9 is not provided, and FIG. 15 shows a structure in which the projecting portion 9 is provided.

Figure 15:
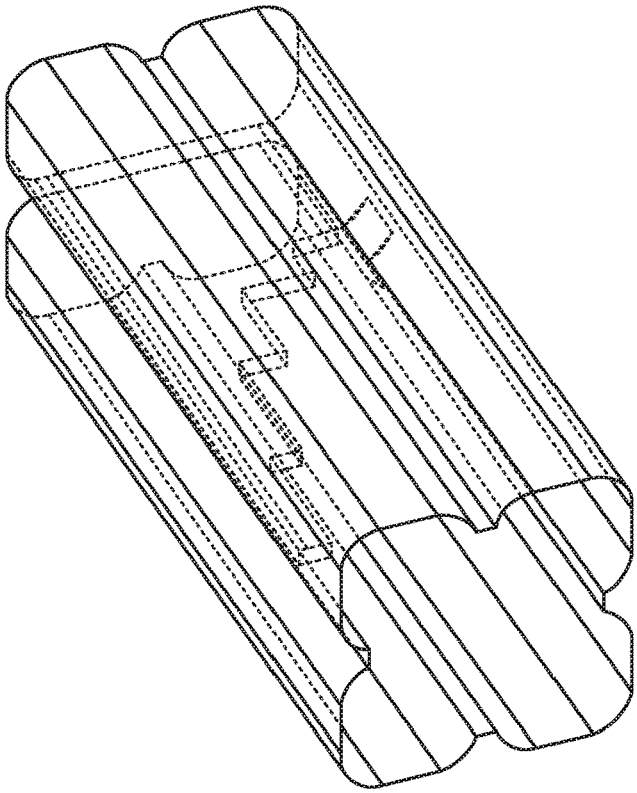
FIG. 15 is a perspective view for a case in which a projecting portion is provided to the polarization separation circuit of the second embodiment of the invention.
Figure 16:
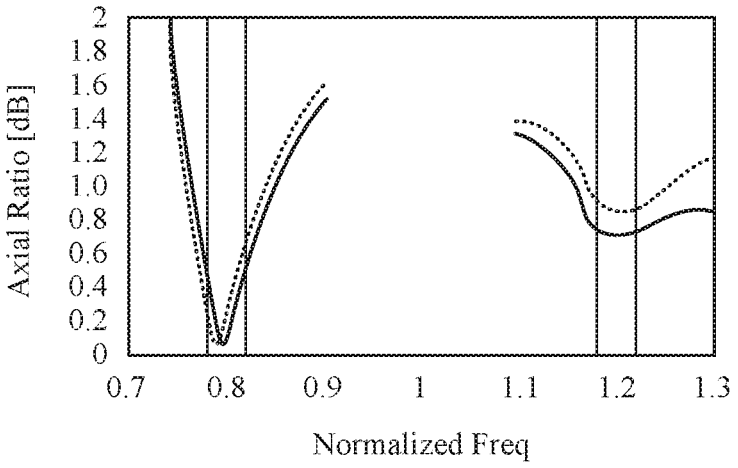
FIG. 16 is an illustrative diagram showing a relationship between axial ratio and frequency for a case in which structures of FIGS. 14 and 15 are designed so as to have equivalent reflectance properties.

FIG. 16 is an illustrative diagram showing a relationship between axial ratio and frequency for a case in which the structures of FIGS. 14 and 15 are designed to have equivalent reflectance properties. In the diagram, solid lines indicate a case in which the projecting portion 9 is provided, and dotted lines indicate a case in which no projecting portion 9 is provided. The frequency bands used are regions each sandwiched by two lines near a normalized frequency of 0.8 and 1.2. It can be seen that the axial ratio is improved (reduced) by about 0.2 dB at high frequencies near 1.2.

As described above, according to the polarization separation circuit of the second embodiment, since the cross-sectional shape of a projecting portion is such a shape that oblique sides that connect a bottom base on a side of the ridge-side wall surface to a top base opposite to the bottom base are formed in a curved shape, processing is easy and excellent axial ratio characteristics can be obtained.

Third Embodiment

In a polarization separation circuit of a third embodiment, the cross-sectional shape of a projecting portion changes in a stepwise manner in a direction parallel to a waveguide axial direction.

Figure 17:
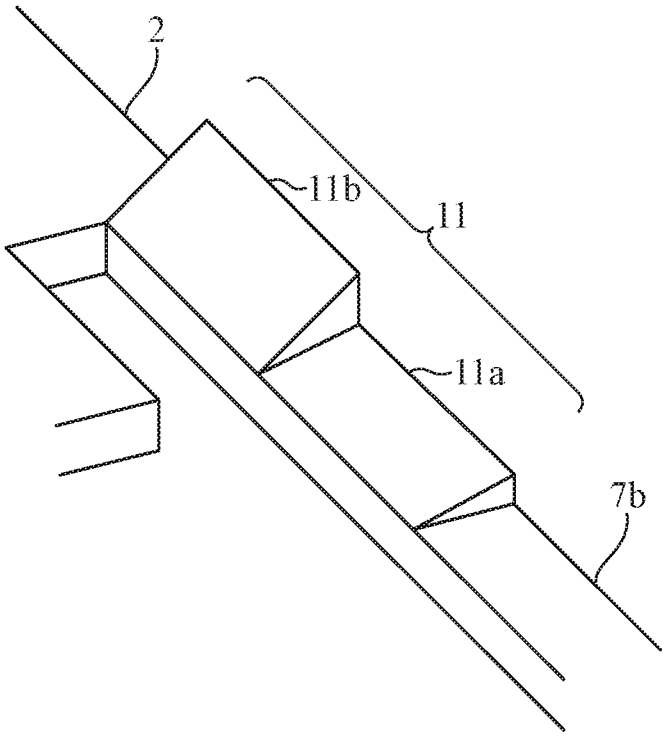
FIG. 17 is a perspective view of a projecting portion of a polarization separation circuit of a third embodiment of the invention.

FIG. 17 is an enlarged perspective view of a portion around a projecting portion for describing a configuration of the polarization separation circuit according to the third embodiment. In FIG. 17, the septum phase plate 2 and the ridge 7*b* have the same configurations as those of the first embodiment or the second embodiment. In a projecting portion 11, two projecting portions with different cross-sectional shapes of trapezoids, a first projecting portion 11*a* and a second projecting portion 11*b*, are provided side by side in parallel to the waveguide axial direction, forming the stepped projecting portion 11. A magnitude relationship between the cross-sectional areas of the first projecting portion 11*a* and the second projecting portion 11*b* is: the first projecting portion 11*a*<the second projecting portion 11*b*. Other configurations of the polarization separation circuit are the same as those of the first embodiment, and thus, description thereof is omitted here.

By such a configuration, too, as in the first embodiment, excellent axial ratio characteristics are obtained.

In addition, since the cross-sectional shape of the projecting portion 11 changes in a stepwise manner in the waveguide axial direction, influence of discontinuity is reduced and there is also an advantageous effect that excellent reflectance properties are obtained.

Note that although here a case in which the cross-sectional shape of a trapezoid is changed to include two steps of cross-sectional shapes is shown, the cross-sectional shape may be changed to include three or more steps of cross-sectional shapes.

As described above, according to the polarization separation circuit of the third embodiment, since the cross-sectional shape of a projecting portion changes in a stepwise manner in parallel to the waveguide axial direction, excellent axial ratio characteristics and excellent reflectance properties can be obtained.

Fourth Embodiment

In a polarization separation circuit of a fourth embodiment, the cross-sectional shape of a projecting portion continuously changes in parallel to a waveguide axial direction.

Figure 18:
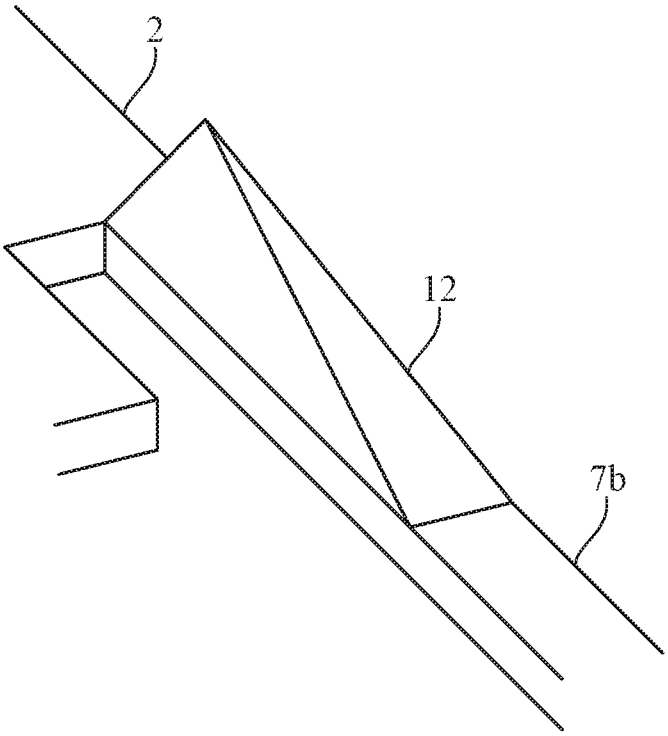
FIG. 18 is a perspective view of a projecting portion of a polarization separation circuit of a fourth embodiment of the invention.
Figure 19:
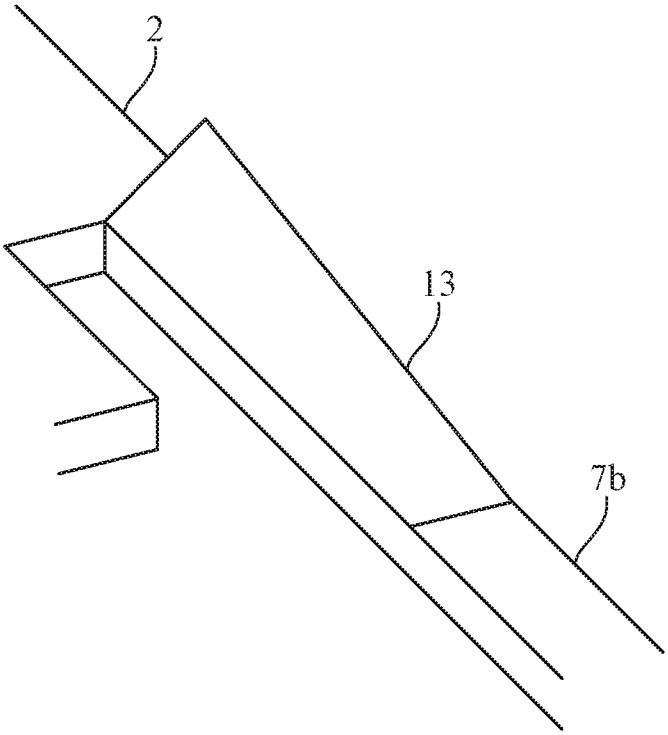
FIG. 19 is a perspective view of another example of a projecting portion of the polarization separation circuit of the fourth embodiment of the invention.

FIG. 18 is an enlarged perspective view of a part around a projecting portion for describing a configuration of the polarization separation circuit according to the fourth embodiment. In FIG. 18, the septum phase plate 2 and the ridge 7*b* have the same configurations as those of the first embodiment or the second embodiment. A projecting portion 12 is formed in such a manner that the cross-sectional shape of the projecting portion 12 continuously changes from a rectangular shape to a trapezoidal shape in a direction from the square waveguide terminal 3 to the rectangular waveguide terminal 4. Other configurations of the polarization separation circuit are the same as those of the first embodiment, and thus, description thereof is omitted here. In addition, FIG. 19 shows another example of a projecting portion 13. The projecting portion 13 is formed in such a manner that the entire cross-sectional shape in the waveguide axial direction of a portion of the projecting portion 13 that changes from a rectangular shape to a trapezoidal shape is trapezoidal. Namely, this configuration corresponds to one in which the number of changes made to the cross-sectional shape of a trapezoid that changes in a stepwise manner in the third embodiment becomes infinity.

By such a configuration, too, as in the first embodiment, excellent axial ratio characteristics are obtained.

In addition, since the cross-sectional shape of the projecting portion 12 continuously changes in the waveguide axial direction, influence of discontinuity is further reduced and there is also an advantageous effect that excellent reflectance properties are obtained.

As described above, according to the polarization separation circuit of the fourth embodiment, the cross-sectional shape of the projecting portion continuously changes along a direction parallel to the waveguide axial direction from a rectangular shape to a trapezoidal shape whose bottom base on a side of the ridge-side wall surface is larger than a top base of the trapezoidal shape opposite to the bottom base. Thus, excellent axial ratio characteristics and excellent reflectance properties can be obtained.

Note that in the invention of the present application, a free combination of the embodiments, modifications to any component of the embodiments, or omissions of any component in the embodiments are possible within the scope of the invention.

INDUSTRIAL APPLICABILITY

As described above, polarization separation circuits according to the invention relate to circuits that separate two orthogonal circularly polarized signals or two orthogonal linearly polarized signals, and are suitable for separating polarized signals in VHF band, UHF band, microwave band, and millimeter wave band.

REFERENCE SIGNS LIST

1: Square waveguide, 2: Septum phase plate, 3: Square waveguide terminal, 4: Rectangular waveguide terminal, 5: Rectangular waveguide terminal, 6*a*, 6*b*, 7*a*, and 7*b*: Ridge, 8, 9, 11, 12, and 13: Projecting portion, 10*a* to 101: Curved-surface portion, 11*a*: First projecting portion, and 11*b*: Second projecting portion.

The invention claimed is:

1. A polarization separation circuit comprising:

a square waveguide whose cross section perpendicular to a waveguide axial direction is square, the square waveguide having four ridges;

a septum phase plate forming two rectangular waveguide terminals by partitioning inside of the square waveguide along the waveguide axial direction, the septum phase plate being formed to get narrower in a stepwise manner as the septum phase plate gets closer to a square waveguide terminal opposite to the two rectangular waveguide terminals of the square waveguide; and a projecting portion provided on a part of a ridge among the four ridges formed on a ridge-side wall surface opposite to a wall surface, the septum phase plate being joined to the wall surface in a part in which the septum phase plate has largest width, the projecting portion being larger than other parts of the ridge in a cross-sectional shape perpendicular to the waveguide axial direction.

2. The polarization separation circuit according to claim 1, wherein the cross-sectional shape of the projecting portion is a trapezoidal shape whose bottom base on a side of the ridge-side wall surface is larger than a top base of the trapezoidal shape opposite to the bottom base.

3. The polarization separation circuit according to claim 1, wherein oblique sides of the cross-sectional shape of the projecting portion, which connect a bottom base on a side of the ridge-side wall surface to a top base opposite to the bottom base in the projecting portion, are formed in a curved shape.

4. The polarization separation circuit according to claim 2, wherein the cross-sectional shape of the projecting portion changes in a stepwise manner along a direction parallel to the waveguide axial direction.

5. The polarization separation circuit according to claim 1, wherein the cross-sectional shape of the projecting portion continuously changes along a direction parallel to the waveguide axial direction from a rectangular shape to a trapezoidal shape whose bottom base on a side of the ridge-side wall surface is larger than a top base of the trapezoidal shape opposite to the bottom base.

* * * * *